United States Patent [19]

Blank

[11] 4,325,532

[45] Apr. 20, 1982

[54] FORMWORK SYSTEM

[75] Inventor: Wilhelm W. A. O. Blank, Nettetal, Fed. Rep. of Germany

[73] Assignee: SGB Group Limited, Surrey, England

[21] Appl. No.: 167,375

[22] Filed: Jul. 9, 1980

[30] Foreign Application Priority Data

Jul. 14, 1979 [DE] Fed. Rep. of Germany ..... 2928480
Feb. 18, 1980 [GB] United Kingdom ..... 05417/80

[51] Int. Cl.[3] ..... E04G 11/48; E04G 11/50; E04G 17/16

[52] U.S. Cl. ..... 249/26; 52/646; 249/50

[58] Field of Search ..... 249/18, 19, 23, 24, 249/28, 29, 212, 25; 264/31, 33, 34; 52/127, 645, 646, 320; 14/3, 5, 13, 14, 15, 17

[56] References Cited

U.S. PATENT DOCUMENTS

| | | | |
|---|---|---|---|
| 680,483 | 8/1901 | Garnsey | 249/25 |
| 1,514,245 | 11/1924 | Ambursen | 249/29 |
| 1,942,093 | 1/1934 | Goldsmith et al. | 249/29 |
| 3,784,151 | 1/1974 | Steele | 249/28 |
| 3,890,750 | 6/1975 | Berman et al. | 249/19 |
| 3,900,182 | 8/1975 | Berman et al. | 249/24 |

FOREIGN PATENT DOCUMENTS

| | | | |
|---|---|---|---|
| 97810 | 5/1978 | Fed. Rep. of Germany | 249/19 |
| 846791 | 9/1939 | France | 249/29 |
| 272777 | 4/1951 | Switzerland | 249/19 |
| 330032 | 7/1958 | Switzerland | 249/24 |
| 428208 | 5/1935 | United Kingdom . | |
| 748665 | 5/1956 | United Kingdom . | |

*Primary Examiner*—Willard E. Hoag
*Attorney, Agent, or Firm*—Buell, Blenko, Ziesenheim & Beck

[57] ABSTRACT

In a formwork system frames are mounted between horizontal supports. The support means on the frames are offset relative to the horizontal axis so that the inversion of the frames enables the level of the upper surface thereof to be adjusted. Thus the same components can be used to make a formwork for fine finish concrete or standard finish. In an alternative embodiment the support means on the horizontal support is offset so that the adjustment can be effected by reversing the support.

10 Claims, 7 Drawing Figures

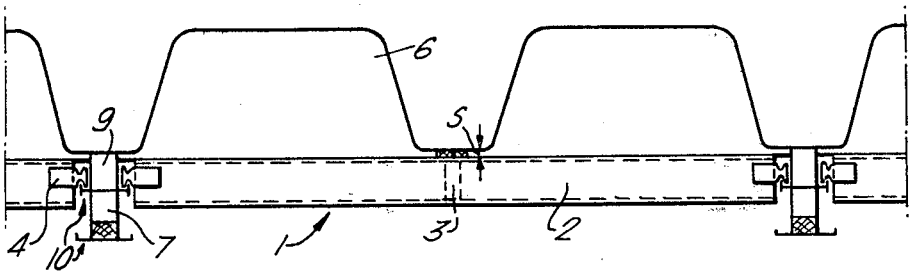
Fig.5.
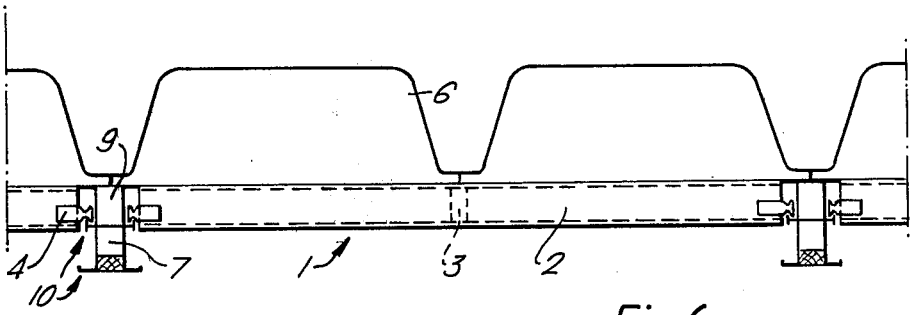
Fig.6.
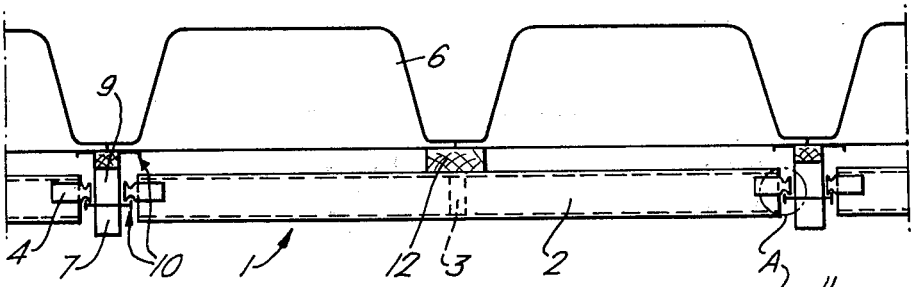
Fig.7.
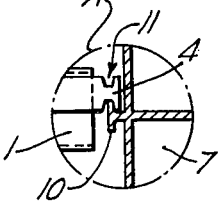

FORMWORK SYSTEM

BACKGROUND OF THE INVENTION

The present invention relates to a formwork system and more particularly relates to a formwork system for use in connection with the formation of concrete ceilings or walls.

When it is desired to construct a ceiling from concrete it is common to provide a formwork comprising a plurality of longitudinal horizontal elements and transverse support elements or frames located between the horizontal longitudinal support elements, these various support elements or frames having large plywood sheets or moulds (which are termed waffle and trough moulds) mounted on the upper surface thereof. The various horizontal longitudinally and transversely extending support elements or frames are supported by props or scaffolding.

It has been proposed to support said longitudinal and transverse support elements by means of props which have a head on which the longitudinal and transverse support elements are mounted which head can be lowered whilst still leaving the prop in position. In utilising such a formwork system concrete can be poured on to the complete formwork assembly and when the concrete is partially cured the heads can be operated to lower the various supports and the associated plywood sheets or waffle and trough moulds, leaving the partially cured concrete supported merely by the props. The various horizontal longitudinal and transverse support elements and the plywood sheets or waffle and trough moulds can thus be utilised in connection with the formation of a separate section of formwork before the first section of ceiling has fully cured. Such a formwork system is described, for example in German Utility Model 7031498 and in British Pat. No. 1,191,578.

The prior proposed formwork systems were designed to fulfill a single role namely, to produce a concrete surface with a standard surface, or to produce a concrete surface with a fine finish or to produce a concrete surface with a waffle and trough finish.

SUMMARY OF THE INVENTION

According to this invention there is provided a formwork system comprising longitudinal support members and support frames or other support members (termed "support frames" herein for convenience) adapted to be mounted on said longitudinal support members for supporting formwork sheets, waffle and trough moulds or the like, said support frames and said longitudinal support members having means for engaging each other, said engagement means being located such that the level of the uppermost surface of the support frame relative to the uppermost surface of the support members can be adjusted by inverting either the support frame or by inverting the support members.

Preferably said engagement means are located so that with the support frame mounted on the longitudinal support element in a first orientation the uppermost surface of the support frame is flush with or above the uppermost surface of the support element, whereas when the support frame is inverted the then uppermost surface of the support frame is a predetermined distance beneath the level of the uppermost surface of the support member. When the frame is in the first position large sheets of plywood for example may be supported or waffle and trough moulds may be supported to enable fine finish concrete to be produced. When the frame is in the second position if said predetermined distance is equal to the thickness of the plywood or waffle and trough moulds standard finish concrete may be produced, but a facility may be provided to enable most of the components of the formwork system to be removed before the concrete is fully cured.

Conveniently said support frame comprises two substantially parallel side members and end members secured to and interconnecting said side members, said end members constituting said engagement means on said frame.

Preferably said end members are offset relative to the horizontal plane of symmetry of the frame so that the edges of an end member are at different distances from said plane of symmetry.

Conveniently locking members are provided on said horizontal support members, the locking members being adapted to engage said end members to lock the frames in position.

Preferably said end members have grooves therein, the longitudinal support elements having support flanges engageable with said grooves.

Advantageously said longitudinal support elements each have at least two means for engaging the frames. Preferably the longitudinal support members are provided with engagement means that can engage said frames in two orientations of the support members, the engagement means on the support members being located so that the level thereof may be altered by inverting the support members.

The system may include including props to support said horizontal support members, said props being provided with quick release means to enable the said longitudinal support members and said frames to be removed, together with said formwork sheets, waffle or trough mouldings or the like leaving said props in position.

The invention also relates to a kit of parts for forming such a system.

BRIEF DESCRIPTION OF THE INVENTION

FIG. 5 is a side elevational view of a second embodiment of a formwork system in accordance with the present invention supporting a waffle and trough mould;

FIG. 6 is a view corresponding to FIG. 5 but showing some of the supports forming part of the formwork system in a different orientation; and FIG. 7 is a further view corresponding to FIGS. 5 and 6 showing a further type of formwork system constructed from the illustrated components, a part of FIG. 7 being shown to an enlarged scale.

DESCRIPTION OF PREFERRED EMBODIMENTS

Figure 1:
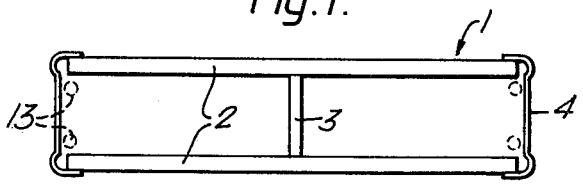
FIG. 1 is a top plan view of a support frame forming part of a formwork system in accordance with the invention.
Figure 2:
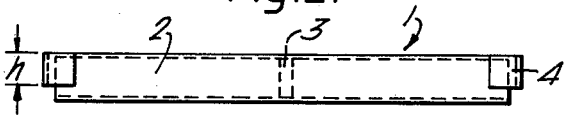
FIG. 2 is a side elevational view of the support frame of FIG. 1.

FIG. 1 is a top plane view of a support frame 1 for use in constructing a formwork assembly, and the support frame 1 comprises two parallel longitudinal members 2 defining two opposed sides of the support frame, the longitudinal members or beams 2 being interconnected by one (or two) central transverse elements 3. At each end of the frame 1 the longitudinal members 2 are interconnected by end pieces of stirrups 4 formed of strip metal. The strip metal end pieces 4 are provided with means to engage a support member such that when the frame is mounted horizontally on a support member the upper surface of the frame is at one level when the frame is in one orientation and is at another level when the frame has been inverted or turned upside down. In the presently described embodiment it is the side edges of the strip metal end pieces 4 that engage the support member, and the end pieces 4 are so connected to the longitudinal side members 2 that when the frame is in a horizontal position, as illustrated in FIG. 2, the uppermost surface of the metal strips constituting the end pieces 4 is flush with the uppermost surface of the frame 1. As can be seen, the height (h) of the end pieces 4 is less than the overall height of the frame 1 and preferably the difference in heights of these elements is substantially equal to the thickness (d) of a sheet of plywood to be utilised with the support frame 1, as will be described hereinafter, or the wall thickness(s) of a waffle trough mould to be utilised with the frames, again as will be described hereinafter. Thus the means to engage the support means are located at different distances from the horizontal axis of symmetry of the frame 1.

As will now be described with reference to FIGS. 3 and 4 the above described support frame 1 may be utilised, when supported on longitudinal horizontal supports which are in turn mounted on support props, to support plywood sheeting 5 to constitute formwork assemblies that may be utilised in connection with the formation of a concrete ceiling having a standard finish or alternatively having a fine finish.

Figure 3:
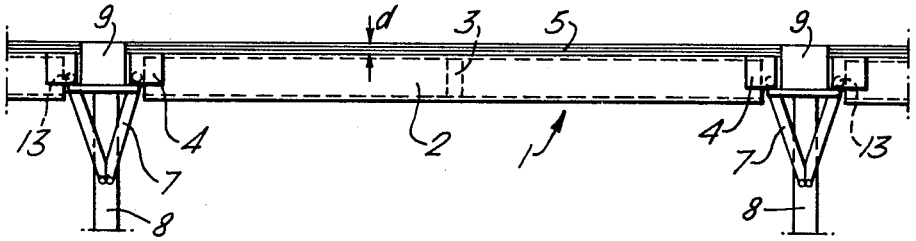
FIG. 3 is a side elevational view similar to FIG. 2, but showing the support frame of FIG. 1 when mounted in position and constituting part of a formwork system.

Referring now to FIG. 3 a support frame 1 as described above is mounted, in the orientation shown in FIG. 2, with the end pieces 4 engaging on horizontal longitudinally extending support members 7 which, in turn, are mounted on vertical props 8. Each support member 7 comprises an upper support portion 9 having two outwardly extending flanges at the lower edge thereof, which flanges are supported by struts. Thus the upper part of the support member has a generally top hat configuration. The end pieces 4 have their lower side edges resting on the flanges of the support member 7. Protrusions or lugs 13 may be provided on the flanges, the protrusions or lugs 13 wedgingly engaging in the recess formed between the end piece 4 and side members 2 of the frame 1 to lock the frame in position. A sheet of plywood 5 having a thickness (d) is mounted on top of the support frame 1 and abuts the support portion 9 of the longitudinal support member 7. The top surface of the plywood sheet 5 is flush with the top surface of the support portion 9. Each support prop 8 will also have a prop head that is flush with the uppermost surface of the plywood sheet 5.

Such a formwork assembly may be utilised for producing a standard concrete surface, concrete being poured onto the surface defined by the uppermost surface of the sheets of plywood 5 the uppermost surfaces of the support portions 9, and the uppermost surfaces of the prop heads. The concrete will then be permitted to cure. One advantage of utilising a formwork system as illustrated in FIG. 3 is that once the concrete has partially cured it is possible to remove the support frames 1 and plywood sheets 5, leaving the partially cured concrete supported by the props 8 and support members 7, although the support members 7 may also be removed. The prop heads (and support members 7, if not removed) provide sufficient support to prevent the partially cured concrete cracking or deforming whilst the curing process is completed. Thus the frames 1 and plywood sheets 5 (and optionally the support members 7) may be utilised in the formation of a further formwork assembly whilst the first section of concrete is still curing. The disadvantage of utilising the formwork system as illustrated in FIG. 3 is that the finish on the concrete is not very fine or smooth since inevitably there are small gaps between the prop head, the support portions 9 and the abutting plywood sheets 5, and also between adjacent plywood sheets 5, and the concrete tends to enter these cracks forming small ridges on the surface of the cast concrete. If a very smooth finish is required these ridges must be removed.

Figure 4:
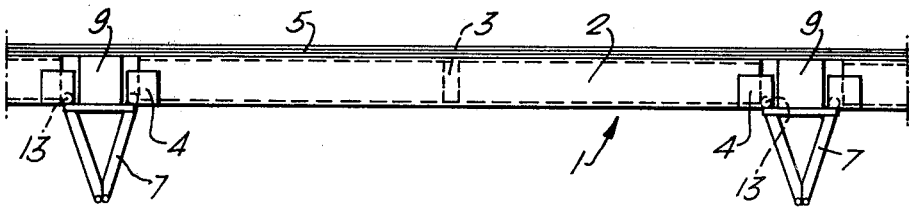
FIG. 4 is a view similar to FIG. 3 but showing the support frame of FIG. 1 in a reverse or inverted orientation.

FIG. 4 illustrates a formwork system which is similar to that illustrated in FIG. 3 save that the support frame 1 has been inverted or turned over. Thus the side of the support frame that was the underside in FIG. 3 is the top side in FIG. 4. As can be seen, the support frame 1 is still supported on the flanges provided on longitudinal horizontal support members 7, but the surface of the support frame 1 that now supports the plywood sheet 5 is flush with the uppermost surface of the support sections 9, and thus also with the prop heads. Consequently a single large sheet of plywood may be located in position to cover the support frame 1 and the adjacent support sections 9 and the prop heads. Thus it will be appreciated that in utilising this particular arrangement very large sheets of plywood may be utilised, leading to a minimum number of gaps between adjacent sheets of plywood and consequently enabling the formation of concrete having a fine finish. However it will be appreciated that one disadvantage of this system is difficult for any of the formwork assembly to be removed before the concrete has cured sufficiently to be totally self-supporting.

FIGS. 5 and 6 illustrate two embodiments of "waffle and trough" formwork. In the embodiment shown in FIG. 5 longitudinal horizontal support members 7 are provided which have the same function as the support members 7 illustrated in FIGS. 3 and 4, the support members 7 again having an upstanding upper support portion 9. The horizontal support members 7 have horizontally extending flanges 10 having upstanding lips which engage in grooves 11 formed in both side edges of the end pieces 4 provided on the frames 1. Each support member 7 has two sets of horizontally extending flanges 10 the flanges being located at two levels. One set of flanges is located at the bottom of the support member, and the other part way, but not half way, up. Thus, as will be described hereinafter the relative level of this other set of flanges may be altered by inverting the support member 7. It will be noted that the stirrups 4 no longer have one surface precisely flush with one surface of the frame 1, but the stirrups 4 are offset from the horizontal axis of symmetry of the support frames 1 so that the grooves 11 which engage the support flanges 10 are located at different distances from the horizontal axis of symmetry of the frame 1.

As can be seen from FIG. 5 the uppermost surface of the support frame 1 is lower than the uppermost surface of the upper support portion 9 of the horizontal support member 7 by distance (s) which is equal to the wall thickness of a waffle and trough mould 6 which is located in position on the support frame 1. A portion of the waffle and trough mould 6 abuts the upper support portion 9 formed on the horizontal longitudinally extending support member 7, and also prop heads on the props which are level with the upper surfaces of the support portions 9. Thus it can be seen that the uppermost surface of the waffle and trough mould 6 is flush with the uppermost surface of the support portions 9 of the horizontally extending support members 7 and with the prop heads.

The arrangement illustrated in FIG. 5 can be utilised in forming standard finish waffle and trough concrete ceilings, and it will be appreciated that in utilising the arrangement illustrated in FIG. 5 the frames 1 and the waffle and trough moulds 6 (and optionally the support members 7) may be removed before the concrete has fully cured, the concrete remaining supported by the props (and the support members 7 if these are not removed) until the concrete has fully cured.

If the support frames 1 are inverted or turned over and again mounted on the upper support flanges of horizontal support member 7, as shown in FIG. 6 of each support frame 1 is then flush with the uppermost surface of the support portion 9 formed on each longitudinally extending support member 7 and with the upper surfaces of the prop heads. Waffle and trough moulds 6 may then be located to contact each other providing a minimum number of joints between adjacent waffle and trough moulds, leading to the formation of fine finish concrete. As with the formwork shown in FIG. 4 the formwork shown in FIG. 6 cannot be dismantled until the concrete has cured sufficiently to be self supporting.

FIG. 7 illustrates a modified formwork system in which frames 1 as illustrated in FIG. 5 are supported in the orientation as illustrated in FIG. 5 on the longitudinal support members 7, the support members 7 having an inverted orientation relative to their orientation in FIGS. 5 and 6. Thus the distance between the support flanges 10 and the part of the support member 7 that now forms the upper support portion 9 is greater than the distance between the flanges 10 and the upper support portion 9 in FIGS. 5 and 6. As shown in FIG. 7 the uppermost part of each support member 7 is located above the uppermost surface of the support frame 1. A longitudinally extending batten of wood 12 is located in position overlying the uppermost surface of the support frame 1 but extending in a direction substantially parallel to the longitudinal support members 7. The thickness of the batten 12 is such that the upper surface thereof is level with the upper surface of the support members 7 and waffle and trough moulds are mounted on the batten 12 and the support members 7. It will be appreciated that in utilising the arrangement illustrated in FIG. 7 a relatively low number of support frames 1 may be utilised, the frames being spaced apart since the moulds 6 are supported on the horizontal support member 7 and the battens of wood 12.

Reference is made to the enlarged portion A of FIG. 7 which shows the grooves 11 formed in the end pieces 4 provided on the frame 1 and shows the nature of the support flanges 10 formed on the longitudinal horizontal support members 7 to engage the stirrups or end pieces 4. The support flanges 10 may be continuous support flanges or fragmented support flanges or may alternatively take the form of cams.

It will be appreciated that the frames 1 may be mounted in either orientation, on the lower flanges 10 of the support members 7 when in the orientation shown in FIGS. 5 and 6, thus providing means for locating the top surfaces of the frames 1 at two further levels relative to the upper surface of the support member 7.

From the foregoing it will be understood that in utilising formwork components as described, formwork assemblies adapted to fulfill a number of roles may be assembled from the same components, the orientation of some of the components being selected, in dependence upon the role that the formwork is to fulfill, during the assembly of the formwork.

If a formwork system as described above is of the type where parts of the formwork may be removed after the concrete has partially set or cured the various support members mounted on the props may be supported by means of a releasable prop head such as that described in German Utility Model 7031498 or that described in British Patent No. 1,191,578. Then the various elements not necessary to support the concrete during the final curing thereof may rapidly be removed for subsequent re-use.

We claim:

1. A support assembly for a concrete form comprising support frames having bracket means mounted at each end engaging longitudinal support members disposed generally transversely of said support frames, said bracket means being located such that the level of the uppermost surface of the support frames relative to the uppermost surface of the longitudinal support members can be adjusted by inverting either the support frame or the longitudinal support members, each of said support frames having plural substantially parallel spaced beams connected by means including said bracket means, and each said bracket means having at least one recess on each of two opposite sides for engaging a cooperating element on said longitudinal support members in one of at least two different relative positions.

2. A formwork system according to claim 1 wherein said bracket means are located so that with the support frame mounted on the longitudinal support member in a first orientation the uppermost surface of the support frame is flush with or above the uppermost surface of the support member, whereas when the support frame is inverted the uppermost surface of the support frame is a predetermined distance beneath the level of the uppermost surface of the support member.

3. A formwork system according to claim 1 wherein said longitudinal support members each have at least two means for engaging the frames.

4. A formwork system according to claim 1 wherein the longitudinal support members are provided with engagement means that can engage said frames in two orientations of the support members, the bracket means or the support members being located so that the level thereof may be altered by inverting the longitudinal support members.

5. A formwork according to claim 1 including props to support said horizontal support members, said props being provided with quick release means to enable the said longitudinal support members and said frames to be removed, together with said framework sheets, waffle or trough moulds.

6. A formwork system according to claim 1 wherein each said support frame comprises two substantially parallel side members and end members secured to and interconnecting said side members, said end members constituting said bracket means on said frame.

7. A formwork system according to claim 6 wherein said end members are offset relative to the horizontal plane of symmetry of the frame so that the side edges of an end member are at different distances from said plane of symmetry.

8. A formwork system according to claim 6 wherein locking members are provided on said horizontal support members, the locking members being adapted to engage said end members to lock the frames in position.

9. A formwork system according to claim 6, wherein said end members have grooves therein, the longitudinal support elements having support flanges engageable with said grooves.

10. A support frame for a concrete form supporting assembly comprising bracket means mounted at each end of said support frame for engaging longitudinal support members disposed generally transversely of said support frames, said bracket means being located such that the level of the uppermost surface of the support frame relative to the uppermost surface of the longitudinal support member can be adjusted by inverting either the support frame or the longitudinal support member, said support frame having plural, substantially parallel-spaced beams connected by means including said bracket means, and each said bracket means having at least one recess on each of two opposite sides for engaging a cooperating element on said longitudinal support members in one of at least two different relative positions.

* * * * *

UNITED STATES PATENT AND TRADEMARK OFFICE

CERTIFICATE OF CORRECTION

PATENT NO. : 4,325,532

DATED : April 20, 1982

INVENTOR(S) : Wilhelm W. A. O. Blank

It is certified that error appears in the above-identified patent and that said Letters Patent are hereby corrected as shown below:

Claim 5, column 7, line 2, "framework" should be --formwork--.

Signed and Sealed this

*Third* Day of *August 1982*

[SEAL]

*Attest:*

GERALD J. MOSSINGHOFF

*Attesting Officer*

*Commissioner of Patents and Trademarks*